US005178223A

United States Patent [19]

Smet

[11] Patent Number: 5,178,223

[45] Date of Patent: Jan. 12, 1993

[54] DEVICE FOR MAKING A HOLE IN THE GROUND

[76] Inventor: Marc Smet, Kasteelstraat 29, 2400 Mol, Belgium

[21] Appl. No.: 719,508

[22] Filed: Jun. 24, 1991

[30] Foreign Application Priority Data

Jul. 10, 1990 [BE] Belgium ..... 09000705

[51] Int. Cl.[5] ..... E21B 7/18

[52] U.S. Cl. ..... 175/424; 166/222

[58] Field of Search ..... 175/67, 424, 56; 166/312, 223

[56] References Cited

U.S. PATENT DOCUMENTS

| | | | |
|---|---|---|---|
| 1,851,565 | 3/1932 | Claytor | 175/424 |
| 2,518,591 | 8/1950 | Aston et al. | 175/67 |
| 2,678,203 | 5/1954 | Huff | 175/424 |
| 3,743,035 | 7/1973 | Tiraspolsky | 175/424 |
| 4,074,779 | 2/1978 | Cheung et al. | 175/67 |
| 4,140,346 | 2/1979 | Barthel | 175/67 |
| 4,296,970 | 10/1981 | Hodges | 299/67 |
| 4,302,052 | 11/1981 | Fischer | 175/67 |
| 4,534,427 | 8/1985 | Wang et al. | 175/67 |
| 4,570,705 | 2/1986 | Walling | 166/77 |
| 4,619,323 | 10/1986 | Gidley | 166/285 |
| 4,744,420 | 5/1988 | Patterson et al. | 166/312 |
| 4,850,440 | 7/1989 | Smet | 175/67 |
| 4,921,057 | 5/1990 | Smet | 175/203 |

FOREIGN PATENT DOCUMENTS

| | | |
|---|---|---|
| 902391 | 9/1985 | Belgium . |
| 2493907 | 5/1982 | France . |
| 979984 | 1/1965 | United Kingdom . |

*Primary Examiner*—Ramon S. Britts
*Assistant Examiner*—Frank S. Tsay
*Attorney, Agent, or Firm*—Foley & Lardner

[57] ABSTRACT

A device for making a hole in the ground has a drilling head having a body. The drilling body includes a passage and a venturi through which rinsing fluid passes. The drilling head has a mechanism mounted on an end thereof for loosening the ground. A first pipe provides pressurized fluid to the mechanism and a second pipe provides rinsing fluid to the passage. A protective casing surrounds the first and second pipes creating a bundle of pipes. A fluid motor drives the mechanism. The venturi receives rinsing fluid from the second pipe thereby creating a suction effect which evacuates rinsing fluid from the hole together with loosened ground.

10 Claims, 3 Drawing Sheets

DEVICE FOR MAKING A HOLE IN THE GROUND

BACKGROUND OF THE INVENTION

1. Field of the Invention

The invention relates to a device for making a hole in the ground, which device includes a drilling head with a body provided with at least one passage for rinsing fluid, means for loosening the ground which are mounted on the body, and at least two pipes, namely a first pipe for fluid under pressure which is connected to the means for loosening the ground and a second pipe for rinsing fluid which connects to the passage.

2. Description of the Related Art

A device of the above-mentioned type is described in Belgian patent no. 905 265. This device comprises two supple hoses surrounding each other. Through the middle hose and a central opening in the body, fluid under high pressure is supplied to one or more guidable, whether or not driven and/or rotating spraying heads, which are mounted on the extremity of the body and which form the means for loosening the ground. Through the annular space between the two hoses rinsing liquid under,. lower pressure but with a higher flow rate can be pumped. The rinsing liquid flows through a channel that is situated next to or around the aforementioned central opening and through openings in the side wall cf the body, exiting in the channel, sideways out of the drilling head and further, under the washing away of loosened ground through the already formed hole toward the surface of the ground.

Although this device already permits many different ways of drilling, such as for example by changing the fluids under high and low pressure, these ways are nevertheless rather limited.

SUMMARY OF THE INVENTION

An object of the invention is to provide a device for making a hole in the ground which offers a greater number of utilization possibilities as compared to the aforementioned existing device.

For this purpose the device comprises a bundle of more than two pipes for fluid located inside a protective casing the body shows a venturi for achieving a suction effect for the evacuation of the rinsing fluid with loosened ground.

The device offers the possibility of simultaneously loosening ground with assistance of fluid under high pressure and utilizing rinsing fluid that is evacuated through a venturi effect. Devices are known which also make use of this venturi effect for the removal of the rinsing liquid and which therefore have a venturi or narrowing-widening on the body of the drilling head, but these devices make no use of fluid under high pressure for the loosening of the ground. The body of the drilling head is provided with cutting instruments and is rotated in the ground around its axis. These devices therefore also offer limited possibilities with regard to the ways of utilization.

The drilling head can be rotatable in relation to the bundle or have a rotatable part. The rotation can be caused by a motor or other mechanical means and/or by the spraying of fluid under high pressure itself.

In a particular embodiment of the invention the drilling head comprises a suction pump mechanism with a venturi which is formed in or on the body and has a passage for sucking away rinsing fluid with loosened ground and with at least one channel for driving fluid exiting in this passage, while the device comprises a bundle of at least three pipes for fluid which are formed inside a protective casing, of which at least one pipe connects to the aforementioned channel for the driving fluid, at least one pipe connects to at least one channel in the body for the actual rinsing fluid, and at least one pipe forms the high pressure pipe for supplying high pressure fluid to the means for loosening the ground.

One or more of the fluid pipes can connect to fluid motors.

In a notable embodiment of the invention the venturi is located in the body and the passage of the venturi is the channel for the actual rinsing fluid.

In another notable embodiment of the invention the pipes and the covering casing of the bundle are flexible hoses.

In an advantageous embodiment of the invention the protective casing itself is one of the pipes, which pipe is then formed by the passage inside the casing around the other pipes.

In the casing and possibly in one of the pipes inside the casing other pipes/cables than fluid pipes can be installed, such as electric cables.

In a suitable embodiment of the invention the means for loosening the ground comprise at least one high pressure spraying channel in the body that is connected to a high pressure pipe.

To this high pressure spraying channel a permanently attached spraying device or a rotating spraying device can be connected.

In place of this high pressure spraying channel or in addition to this high pressure spraying channel the device can comprise an instrument that is driven by fluid. This instrument can be a so-called turbojet.

In another embodiment this instrument can be a rotating jet of which the spraying direction deviates from the rotation axis of the rotating jet directed parallel to the axis of the body, which rotating jet connects to a supply pipe of fluid under high pressure for spraying, while the rotation of the jet is caused by a fluid motor which is driven by fluid under high pressure supplied through another pipe which extends through the body and the casing.

Abrasive means can be added to the fluid that is sprayed through the rotating jet.

In yet another embodiment the instrument can be a fluid hammer which is connected to a supply pipe for fluid and which comprises a fluid motor for its rotation, which fluid motor is driven by fluid that is also supplied via a pipe.

BRIEF DESCRIPTION OF THE DRAWINGS

Other details and advantages of the invention will appear from the following description of a device for making a hole in the ground according to the invention. This description is only given as an example, and does not restrict the scope of invention in any way. The reference figures refer to the drawings attached hereto, in which.

DETAILED DESCRIPTION OF PREFERRED EMBODIMENTS

Figure 1:
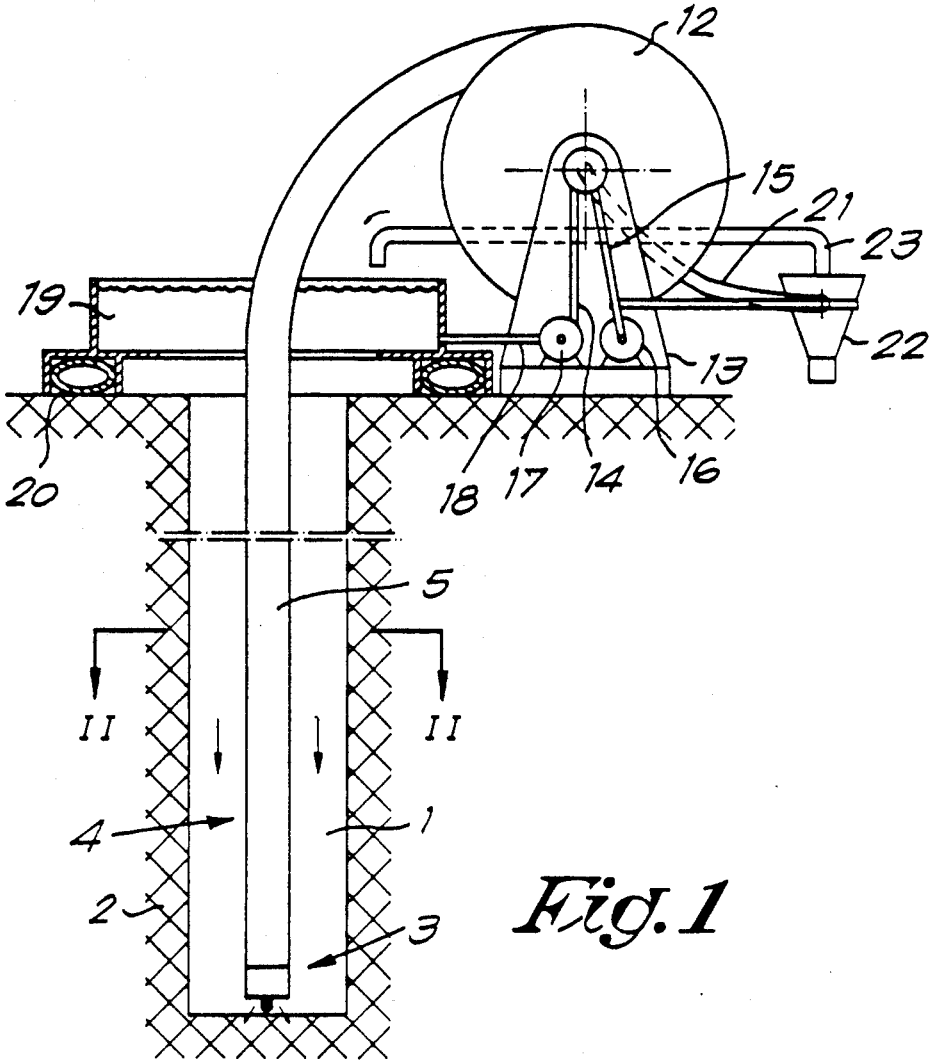
FIG. 1 schematically shows a device for making a hole in the ground according to the invention.

The device for making a hole 1 in the ground 2 according to FIG. 1 includes a drilling head 3 which is attached to an extremity of a bundle of hoses 4. The bundle is formed by a flexible casing 5 in which a number of flexible hoses are situated, namely a central hose 6, two high pressure hoses 7 and five low pressure hoses 8. A high pressure hose as discussed herein is one which can withstand pressures of 70 bars or more. The hoses 7 and 8 are mounted between the. central hose 6 and the casing 5. All of the hoses 6, 7, 8 form pipes through which fluid can pass while the remaining space 9 inside the casing 5 and around the hoses 6 to 8, can also be used as pipe for the passage of fluid. In the space 9, electric cables 10 are disposed, as well as reinforcing threads 11 which are for example, woven into a loose fabric that is glued to the inside of the casing 5 or even incorporated into the casings. These reinforcing threads 11 can also be steel cables.

The bundle 4 can be rolled from or on a drum 12. This drum is rotatable around a horizontal shaft on a support 13 which is disposed on the surface of the ground or a vehicle. The drum 12 is rotated in either direction by means of a motor, which for the sake of clarity is not shown in FIG. 1. The high pressure hoses 7 respectively the low pressure hoses 8 are connected to each other in the hollow shaft of the drum 12 and by means of a rotating coupling via a pipe 15 respectively 14 to a high pressure pump 16 respectively low pressure pump 17. The high pressure pump 16 is connected to liquid reservoir (not shown). The low pressure pump 17 is connected ,by a pipe 18 to a reservoir 19 containing rinsing liquid. The reservoir 17 has no bottom but rests on the ground 2 by means of seal 20. The reservoir surrounds the hole 1 that is also filled with rinsing liquid around the bundle 4. The central hose 6 connects via a swivel coupling. in an analagous manner to that discussed above, to a pipe 21 which exits into tory funnel 22. The loosened ground which is removed together with rinsing through the central hose 6 settles in the funnel 22. The sand from the loosened ground is removed underneath the funnel. The overflow 23 from this funnel exits in the reservoir 19. Thus, the funnel 22 stores a certain volume of the removed rinsing liquid such that the sand or other particles in the rinsing liquid settle in the bottom of the funnel due to gravity. The portion of rinsing liquid at the top of funnel 22 is therefore free of loosened ground or other particles and passes back to the reservoirs via overflow line 23.

Figure 3:
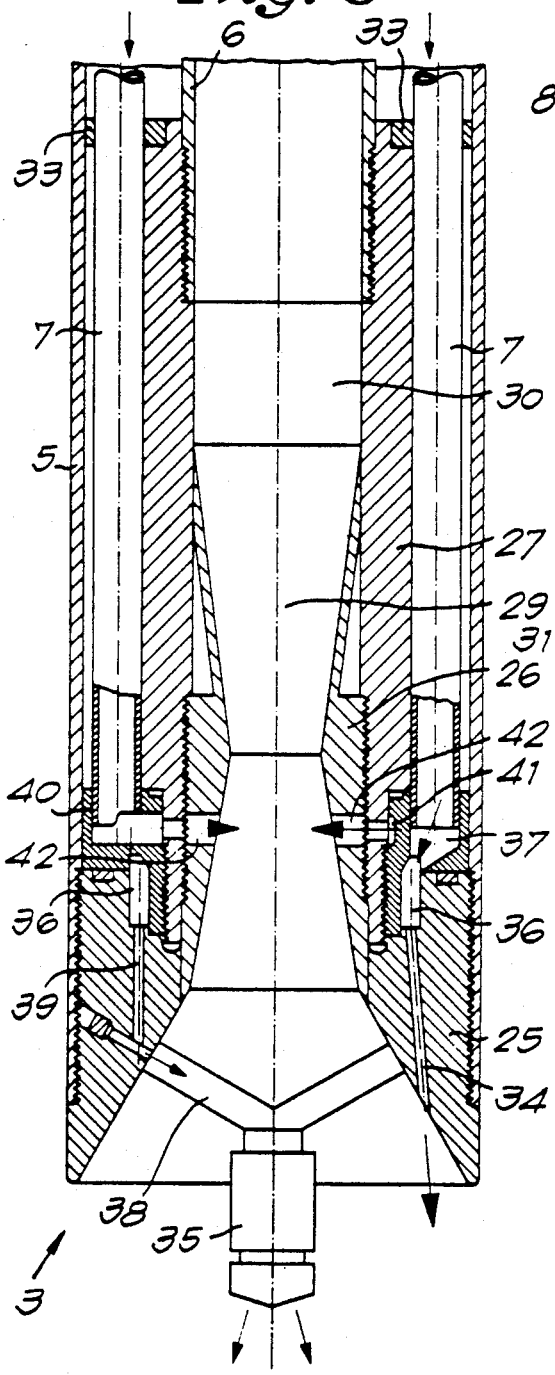
FIG. 3 shows a section according to the line III—III from FIG. 2, of the lower extremity of the device.
Figure 4:
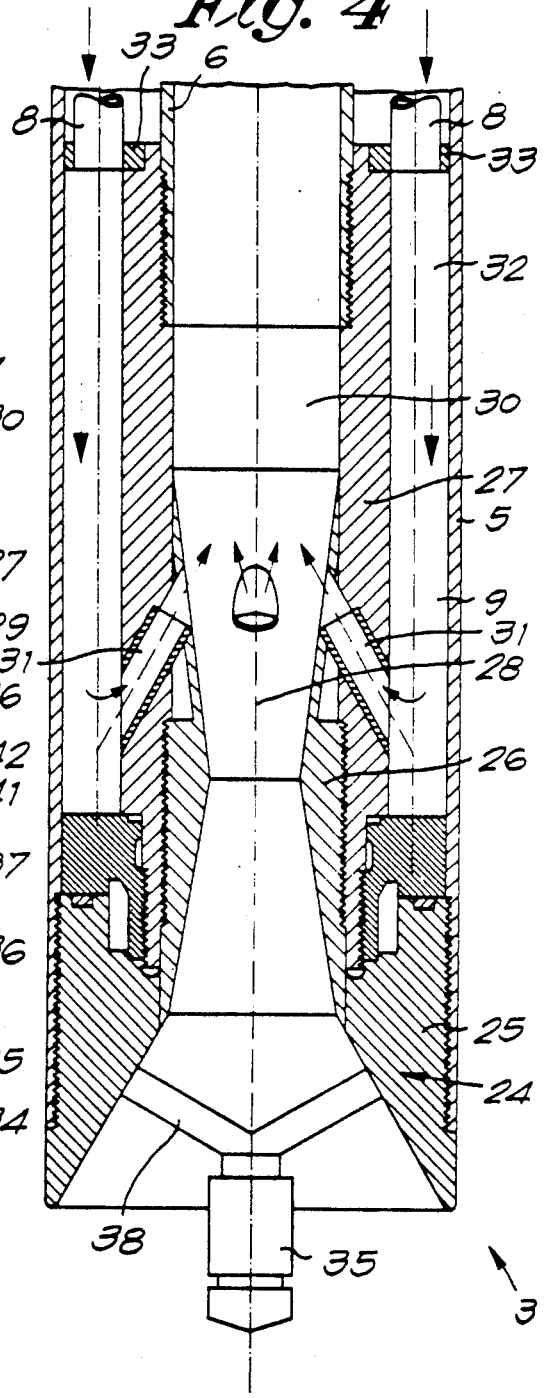
FIG. 4 shows a section analogous to that of FIG. 3 but taken along to the line IV—IV of FIG. 2.

As appears from FIGS. 3 and 4, the drilling head 3 includes a body 24 consisting of four parts 25 to 28 which are screwed into each other. The part 25 forms a terminal piece widening toward the extremity onto which the extremity of the casing 5 is screwed. The middle part 26 forms a venturi, which, as viewed from top to bottom in FIGS. 3 and 4, is a tube which has top portion that continually narrows and a bottom portion that continually widens. The middle part is situated axially in relation to the drilling head 3. The passage 29 of the venturi, 26 on the one hand, exits in the opening of the extremity 25, and on the other hand opens in a channel 30 of the intermediate part 27. Intermediate part 27 is screwed at one extremity onto the extremity of the central hose 6 and at the other extremity is screwed onto the venturi 26. and is also screwed into the part 28 that forms a ring which is mounted on the extremity 25.

Four channels 31 extend through the intermediate part 27 and the venturi 26. These channels are directed obliquely in the direction of the channel 30 and exit into the passage 29 of the venturi 26 in the widening part of it connecting to the channel 30. These channels 31 are also connected to the annular space 32 formed between the middle part 27 and the casing 5, above the ring 28, which intermediate space 32 is sealed off by a sealing ring 33 at a distance from the ring 28, around the extremity of the central hose 6. The aforementioned low pressure hoses 8 exit into this annular intermediate space 32.

During the making of the hole, rinsing liquid is pumped by the low pressure pump 17 out of the reservoir 19 and, through the low pressure hose 8 and the aforementioned intermediate space 32, via the channels 31 is sprayed into the passage 29 of the venturi. An important suction force therefore develops in the venturi 26 through which rinsing liquid which is in the drilling hole 1 is sucked toward the surface of the ground, through, the venturi passage 29, the channel 30 and the central hose 6. The sucked rinsing liquid, which carries along the loosened ground, is then moved to the separatory funnel 22, and after the heavy particles in the liquid have dropped to the bottom of the separating funnel only the cleaned rinsing liquid is sent back to the reservoir 19 via passage 23. The rinsing liquid which is sprayed through the channels 31 into the venturi 26 serves as a driving liquid for bringing to the surface the rinsing liquid which carries along the loosened ground. The channels 31 together with the venturi 26 form a suction pump mechanism.

The ground in the hole 1 is on the one hand loosened by fixed spraying channels 34 which are directed in the direction of movement somewhat obliquely in relation to the longitudinal axis of the drilling head 3, and by an additional instrument 35 that is mounted on the extremity of the body 24.

The spraying channels 34 extend through the terminal piece 25 of the body 24 and connect to an annular space 36 which is formed between the terminal piece 25 and the ring 28. One of the high pressure hoses 7 extends through the sealing ring 33, and the aforementioned spaces 32 and is mounted with its extremity into an opening 37 in the ring 28, which opening exits into the aforementioned space 36. Liquid is supplied under high pressure by the pump 16 through the high pressure hose 7 to the channels 34 which spray this liquid in front of the drilling head 3.

In the embodiment according to FIGS. 3 and 4 the instrument 35 is a so-called turbojet or a rotating spraying head. This turbojet or rotating spraying head 35 is suspended on the extremity of the body 24 from branches 38 which are attached to the terminal piece 25 and at the same time form pipes for the passage of liquid under high pressure. These branches 38 are connected to the aforementioned annular spaces 36 by channels 39 which extend through the terminal piece 25 so that the high pressure pump 16 also pumps liquid under high pressure to the turbojet or rotating spraying head 35.

The other high pressure hose 7 also extends through the sealing ring 33 and the annular intermediate space 32 into openings 40 in the ring 28. These openings 40 are connected to an annular opening 41 which is formed between the ring 28 and the intermediate part 27 and is connected to the passage 29 of the venturi 26 via radial channels 42. These channels 42 exit in the passage 29 in the part of this passage which narrows as it moves away from the extremity of the device, close to the narrowest point. A high pressure jet can therefore be sprayed in the passage 29 by the high pressure pump 16 via these channels 42 in order to crush pieces of ground which were carried along with the rinsing liquid and remain stuck in the narrow part of the passage.

Figure 5:
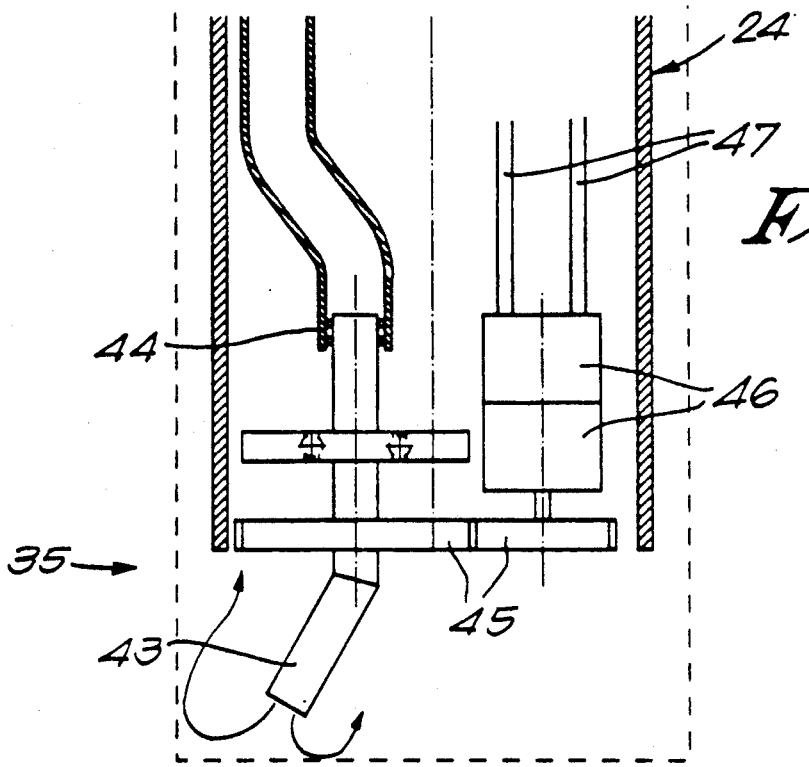
FIG. 5 schematically shows a second embodiment of a section of the lower extremity of the drilling head of the device of FIG. 1.

The embodiment according to FIG. 5 only differs from the above described embodiment through the fact that another instrument is utilized in place of a turbojet 35, namely a so-called rotating jet 43. This rotating jet is driven by water to which abrasive means are added. This water with abrasive means is supplied through one of the low pressure hoses 8 which is extended through the intermediate space 32 and the body 24 and is connected to the rotating jet 43 by a rotating coupling 44. The rotating jet 43 is driven through intervention of a gear 45 by a hydraulic or pneumatic motor 46. The supply and drainage of the fluid for driving this motor are effected along supple hoses 47 which extend through the body 24, the intermediate space 32 and inside the casing 5 to above the ground.

The above mentioned turbojet or rotating spraying head 35 or rotating jet or spraying device 43 can be used in place of or together with, a rotation in itself, whether or not caused by a motor, and can be mounted eccentrically on a disk which is rotatably mounted in the body 24 and driven by a motor, preferably a fluid motor which is supplied via one of the aforementioned hoses 7 or 8.

Figure 6:
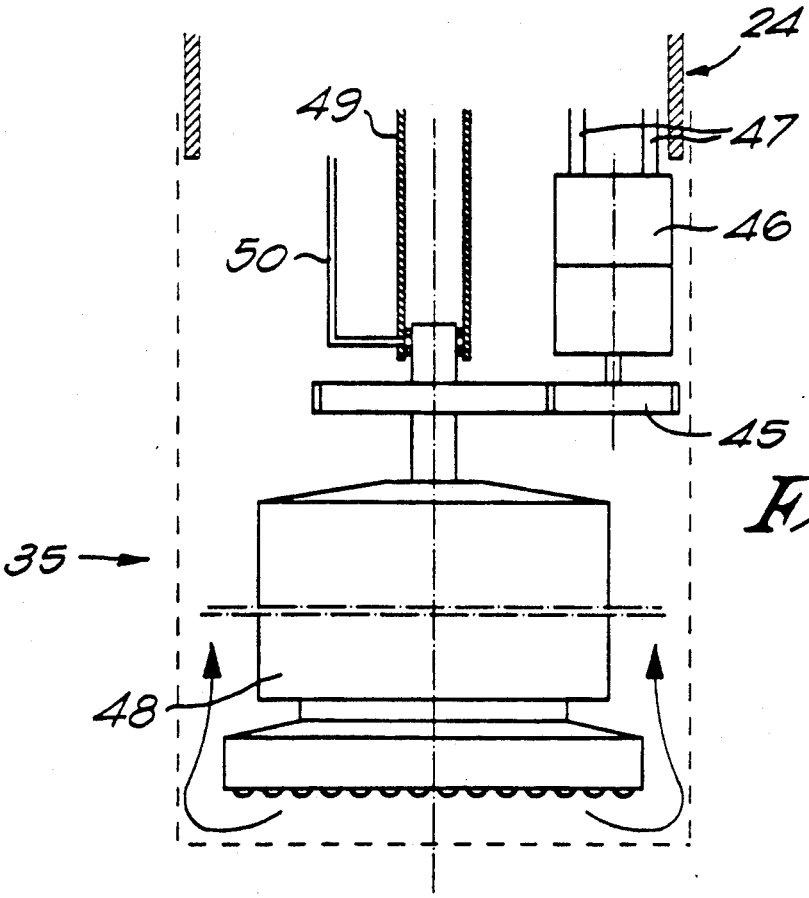
FIG. 6 schematically shows a section analogous to that of FIG. 5 of a third embodiment of a lower extremity of the drilling head.

The embodiment of the device according to FIG. 6 differs from the above described embodiments through the fact that the instrument 35 is a rotating pneumatic hammer 48. This hammer 48 is driven in the same manner as the rotating jet 43 by means of a fluid motor 46 through intervention of a gear 45. The supply and drainage hoses for driving the motor 46 and the hose 49 for supplying air for the operation of the hammer 48 extend through the body 24 and the casing 5 to above the surface of the ground. Foam can be supplied to the pneumatic hammer 48 via a pipe 50 which extends according to the same way.

In FIGS. 5 and 6 only the instrument 35 is shown, this is the part of the drilling head 3 that is located under the venturi 26.

The axis of the drilling head 3 is not necessarily directed vertically. With the device it is also possible to bore obliquely and even horizontally in the ground. Means can be provided for steering the drilling head 3 in the ground. This steering can for example occur through influence on the direction in which the fluid under high pressure is sprayed and/or the amount of this fluid.

The above described device offers an enormous amount of application possibilities and modes of operation. The instrument 35 can be removably mounted in which case it is possible to work without an instrument or to replace one instrument by another.

Figure 2:
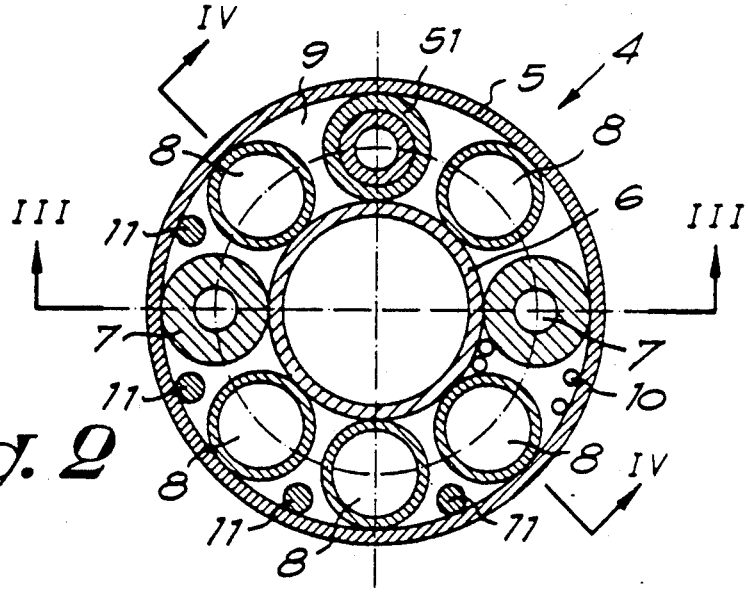
FIG. 2 shows a section according to the line II—II from FIG. 1, drawn to a larger scale.

The location of the drilling head in the ground and the drilling direction can be measured by measurement instruments mounted in the drilling head 3. The information from these instruments can be transmitted either by hydraulic means via hoses or by electrical means via an electric wire 10 to the surface. In FIG. 2 such a measurement hose 5 is situated inside the casing 5. Insofar electric motors are mounted in or on the drilling head 3 these can also receive current via an electric wire 10.

The present invention is in no way restricted to the embodiment described above, and within the scope of the patent application many changes can be applied to the described embodiments.

I claim:

1. A device for making a hole in the ground, comprising: a drilling head having a body, said body including a passage and a venturi and wherein rinsing fluid passes through said passage and said venturi;

means, mounted on said body, for loosening the ground;

a first pipe through which pressurized fluid passes, said first pipe being connected to said loosening means and providing pressurized fluid thereto;

a second pipe through which rinsing fluid passes, said second pipe being connected to said passage;

a protective casing surrounding said first and second pipes, thereby creating a bundle of pipes; and a fluid motor which drives said loosening means;

wherein said venturi receives rinsing fluid from said second pipe thereby creating a suction effect which evacuates, via the passage, rinsing fluid from the hole together with the loosened ground.

2. A device according to claim 1, wherein the loosening means includes a rotating jet having a spraying direction which deviates from a rotational axis of said rotating jet, said rotational axis is parallel to an axis of said body, and said first pipe is connected to said rotating jet such that pressurized fluid is provided to said rotating jet, and further comprising a third pipe through which high pressure fluid is provided to said fluid motor to drive said fluid motor, said third pipe extending through said drilling head and said protective casing.

3. A device for making a hole in ground, comprising:

a head having a body with a front end;

a venturi mounted in said body, said venturi having a central passage;

channels through which driving fluid passes, said channels ending in said central passage;

a turbojet mounted at said front end of said body;

a bundle of first, second, and third flexible hoses; and a flexible protective casing surrounding said bundle and holding said bundle together;

wherein said first hose is a high-pressure hose connected to the turbojet to provide high pressure fluid thereto, said second hose is connected to said central passage, said third hose is connected to said channels to provide driving fluid thereto, and driving fluid is provided to said venturi via said channels, thereby creating a suction effect so that loosened ground is removed from said device.

4. A device for making a hole in the ground, comprising:

a head having a body with a front end;

a venturi mounted in said body, said venturi having a central passage;

channels through which driving fluid passes, said channels ending in said central passage;

a fluid motor mounted in said body;

a ground loosening tool driven by said fluid motor and mounted at the front end of said body;

a bundle of first, second, and third flexible hoses; and a flexible protective casing surrounding said bundle and holding said bundle together;

wherein said first hose is a high-pressure hose connected to the fluid motor to provide high pressure fluid thereto, said second hose is connected to said central passage said third hose is connected to said channels to provide driving fluid thereto, and driving fluid is provided to said venturi via said channels, thereby creating a suction effect so that loosened ground is removed from said device.

5. The device according to claim 4, wherein said tool is a rotating jet, and said bundle includes a fourth flexible hose, said fourth hose being a high pressure hose connected to said rotating jet for providing pressurized fluid thereto.

6. The device according to claim 4, wherein said tool is a pneumatic hammer, and said bundle includes a fourth flexible hose, said fourth flexible hose being connected to said pneumatic hammer.

7. A device for making a hole in the ground, comprising:

a head having a body with a front end;

a venturi mounted in said body, said venturi having a central passage;

channels through which driving fluid passes, said channels ending in said central passage;

a turbojet mounted at said front end of said body;

a bundle of first and second flexible hoses; and a flexible protective casing, having an inner side, surrounding said bundle and holding said bundle together such that a free space is defined between said inner side and said first and second flexible hoses;

wherein said free space acts as an additional hose for transporting fluid, one of said first, second and additional hoses being a high-pressure hose connected to the turbojet to provide high pressure fluid thereto, another of said first, second and additional hoses being connected to said central passage, and still another of said first, second and third hoses being connected to said channels to provide driving fluid thereto;

wherein said driving fluid is provided to said venturi thereby creating a suction effect so that loosened ground is removed from said device.

8. A device for making a hole in the ground, comprising:

a head having a body with a front end;

a venturi mounted in said body, said venturi having a central passage;

channels through which driving fluid passes, said channels ending in said central passage;

a fluid motor mounted in said body;

a ground loosening tool driven by said fluid motor and mounted at the front end of said body;

a bundle of first and second flexible hoses; and a flexible protective casing, having an inner side, and surrounding said bundle and holding said bundle together such that a free space is defined between said inner side and said first and second flexible hoses;

wherein said free space acts as an additional hose for transporting fluid, one of said first, second and additional hoses being a high-pressure hose connected to the turbojet to provide high pressure fluid thereto, another of said first, second and additional hoses being connected to said central passage, and still another of said first, second and third hoses being connected to said channels to provide driving fluid thereto;

wherein said driving fluid is provided to said venturi thereby creating a suction effect so that loosened ground is removed from said device.

9. A device according to claim 8, wherein said tool is a rotating jet, said bundle further includes a third flexible hose, and one of said first, second, third and additional hoses is a high pressure hose which is connected to the rotating jet.

10. A device according to claim 8, wherein said tool is a pneumatic hammer, said bundle includes a third flexible hose, and one of said first, second, third and additional hoses is connected to said pneumatic hammer.

* * * * *